United States Patent [19]

Federighi et al.

[11] Patent Number: 4,936,689

[45] **Date of Patent: * Jun. 26, 1990**

[54] STATIC MATERIAL MIXING APPARATUS

[75] Inventors: James L. Federighi, Cary; Anthony R. Federighi, Palatine, both of Ill.

[73] Assignee: Koflo Corporation, East Dundee, Ill.

[ * ] Notice: The portion of the term of this patent subsequent to Apr. 16, 2002 has been disclaimed.

[21] Appl. No.: 388,762

[22] Filed: Aug. 2, 1989

Related U.S. Application Data

[63] Continuation of Ser. No. 217,330, Jul. 11, 1988, abandoned.

[51] Int. Cl.[5] ..... B01F 5/00; B01F 15/02

[52] U.S. Cl. ..... 366/337; 138/42; 366/338

[58] Field of Search ..... 366/336–340, 366/341, 349; 137/896; 138/38, 40, 42, 46; 48/180.1

[56] References Cited

U.S. PATENT DOCUMENTS 4,511,258 4/1985 Federighi et al. .

4,692,030 9/1987 Tauscher et al. ..... 366/337

OTHER PUBLICATIONS

Koch Engineering Company, Inc., Bulletin KSM-5, entitled Static Mixing Technology, date unknown.

*Primary Examiner*—Timothy F. Simone

*Attorney, Agent, or Firm*—Wallenstein, Wagner & Hattis, Ltd.

[57] ABSTRACT

A static material-mixing apparatus is disclosed. The static material-mixing apparatus comprises a conduit having an axis and defining a chamber extending longitudinally therethrough opening on first and second ends of the conduit and a mixing element including two continuous segments in the chamber between the first and second ends, each having a generally sinuous cross-section between the first and second ends, the segments being disposed in radially spaced relationship with each other.

10 Claims, 1 Drawing Sheet

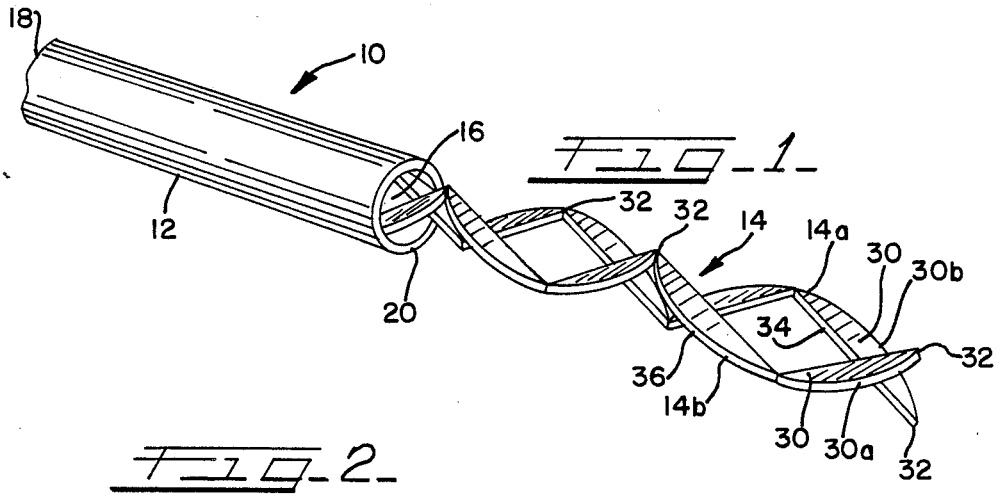
FIG. 1
FIG. 2
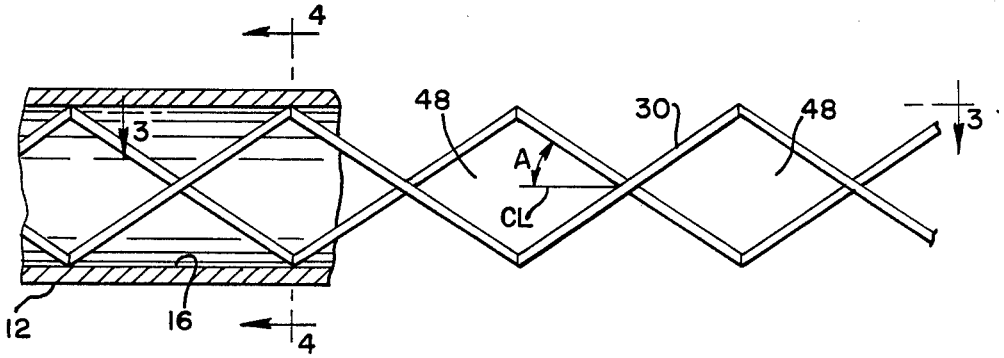
FIG. 3
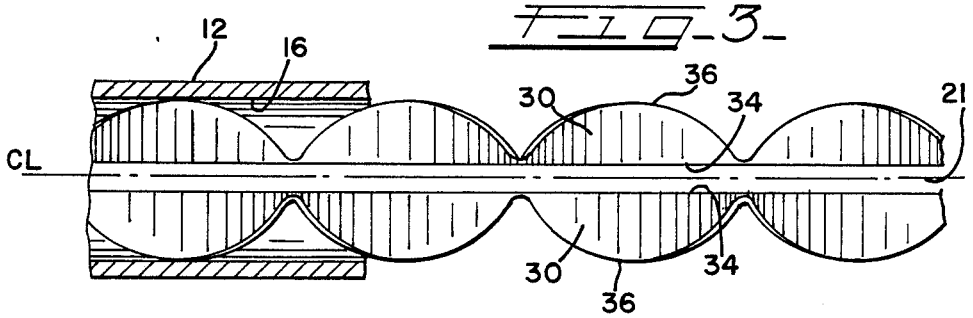
FIG. 4
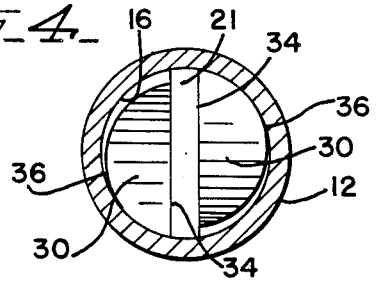

STATIC MATERIAL MIXING APPARATUS

This is a continuation of co-pending application Ser. No. 217,330, filed on July 11, 1988, abandoned.

DESCRIPTION

Technical Field

The present invention relates to static material mixers and, more particularly to a static material mixer which permits passage of solids.

BACKGROUND OF THE INVENTION

Static material mixers are well known as a means for mixing a plurality of materials into a single mass without a need for a rotary mixer, such as a motor. See for example Federighi et al, U.S. Pat. No. 4,511,258 entitled "Static Material Mixing Apparatus". However when mixing liquids which contain solids, such prior art static material mixers are prone to clogging when the solids pass through. This clogging requires repeated maintenance which is expensive and can be quite distasteful, such as when the static material mixer is utilized to mix raw sewage.

The invention is provided to eliminate some or all of the above problems.

SUMMARY OF THE INVENTION

It is an object of the invention to provide a static material-mixing apparatus.

In accordance with the invention, the static material-mixing apparatus comprises a conduit having an axis and defining a chamber extending longitudinally therethrough opening on first and second ends of the conduit and a mixing element including two continuous segments in the chamber between the first and second ends, each of said segments having a generally sinuous cross-section between the first and second ends, the segments being disposed in radially spaced relationship with each other.

The conduit and the chamber are circular in cross section and each of the segments includes a plurality of angularly-related plates interconnected at opposite ends.

Adjacent plates of the respective segments are angularly related in opposite directions and the plates define angles of the order of thirty-five degrees to forty-five degrees with respect to the axis. The spaced relationship provides a gap between the two segments of approximately five to eighty percent of the diameter of the chamber.

Other features and advantages of the invention will be apparent from the following specification taken in conjunction with the accompanying drawings.

BRIEF DESCRIPTION OF THE DRAWINGS

FIG. 1 is an exploded perspective view of the static mixing apparatus according to the invention;

FIG. 2 is a side elevational view partly in section as viewed along line 2—2 of FIG. 1;

FIG. 3 is a plan view as viewed along line 3—3 of FIG. 2; and

FIG. 4 is a cross sectional view as viewed along line 4—4 of FIG. 2.

INCORPORATION BY REFERENCE

The following specification incorporates by reference the specification of Federighi et al, U.S. Pat. No. 4,511,258 entitled "Static Material Mixing Apparatus".

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated herein.

FIG. 1 of the drawings discloses a static mixing device, generally designated 10, consisting of a conduit 12, and a mixing element 14 that is adapted to be inserted into the conduit 12 to define tortuous flow paths for a plurality of fluids so that the fluids are mixed into a homogeneous mass. The conduit 12 may be constructed of plastic, metal or other suitable materials. Preferably, the conduit 12 is circular in cross-section and defines an internal chamber 16 which is open at opposite ends 18 and 20. The diameter of the conduit 12 may be of any dimension, though diameters of ½" to 60" are typical. The opposite ends 18 and 20 may have suitable fittings thereon for connection to sources of materials that are to be mixed, and these have been deleted from the drawings for purposes of clarity.

The mixing element 14 comprises two segments, **14*a*, 14*b* of a specific configuration which each can be formed from flat sheets of stock material. After the two segments 14*a*, 14*b* have been formed, they are inserted into the conduit 12 in a radially spaced relationship, providing a gap 21 there-between (FIGS. 3 and 4) and are secured therein to the conduit 12, as by an adhesive if the conduit 12 is plastic or by welding if the conduit 12 is metal. The two segments 14*a*, 14*b*** each essentially consist of identical segments that have what may be termed as a "sinuous cross-section" between opposite ends.

As illustrated in greater detail in FIG. 4, each of the two segments **14*a*, 14*b* occupies less than one-half of the cross-sectional area of the conduit 12, or internal chamber 16, thereby providing the gap 21** permitting passage of solids.

More specifically, with reference to FIG. 1, each of the segments **14*a*, 14*b* consist of a plurality of identical, generally flat plates 30 that are joined to each other at opposite ends 32. Each of the plates has a substantially planar inner surface or edge 34 (FIG. 4) and an outer edge 36 that conforms generally to the peripheral configuration of chamber 16, which is defined by the inner surface of conduit 12. The two substantially identical segments 14*a*, 14*b* are preferably axially-staggered with respect to each other, as illustrated in FIGS. 1 and 2, and the plates 30 define an angle A with respect to a central axis or central line CL of the conduit 12 The greater the angle, the greater the mixing capability of the mixing device 10 per unit length: however, a greater angle also results in a greater back-pressure and, hence, a greater pressure drop across the mixing device 10**. The angle A can be of the order of about 25° to about 50°, or preferably about 30° to about 45°, for the preferred form of the present invention.

Referring to FIG. 2, the plates 30 of the respective segments 24 define substantially equal angles with respect to center line CL, but the angles extend in opposite directions from the center line to define a plurality of what may be termed generally diamond-shaped cavities or mixing chambers, generally designated by reference numeral 48.

Once inserted into the conduit 12, the mixing element 14 defines a tortious path for a plurality of materials that are intended to be mixed. For example, a first fluid could be connected by a conduit to one side of the center of the inlet 20 and a second fluid could be connected to the inlet 20 adjacent the opposite side of the center. Thus, the first fluid would flow generally downwardly along a first plate or baffle 30*a* (FIG. 1), while the second fluid would flow generally upwardly along baffle 30*b*. Both fluids are therefore forced towards the first mixing chamber from opposite sides of the center of the conduit 12 and the mixing process is commenced. As the two fluids are entering the first mixing chamber 48, the fluids are spinning, which produces a swirling action. The partially mixed fluids will be split again by the edges of the plates 30 as they leave the first mixing chamber 48 and are directed to the next mixing chamber 48.

Of course, the respective fluids which are then partially mixed are again moved to the next succeeding mixing chamber 48 by pressure of the fluid on the inlet, but enter again from opposite sides of the center of the conduit 12 for further mixing of the fluids. The process is continued alternately in each of the mixing chambers 48 along the entire length of the mixing element 14 within the conduit 12 until a totally homogeneous mass is produced, which flows out of the outlet 18.

A primary benefit of the invention is that solids suspended within the fluids can pass through the internal chamber 16 via the gap 21 without clogging. The gap 21 can be of the order of 5–80% of the radial width of the internal chamber 16, depending on the particular solids involved, though 33% has been found generally acceptable.

In certain circumstances, the presence of the gap 21 can reduce the per unit length mixing efficiency of the static mixing device 10 as compared to the device disclosed in the Federighi et al. '258 patent. However, this can be accommodated if necessary by simply increasing the length of the static mixing device 10.

The selection of material for producing the static mixing device 10 will depend upon the particular application, and the static mixing device 10 can be formed from metal or various plastic materials.

We claim:

1. A static material-mixing apparatus comprising:

a conduit having an axis and defining a chamber extending longitudinally therethrough opening on first and second ends of said conduit; and a mixing element including two continuous segments in said chamber between said first and second ends, each having a generally sinuous cross-section between said first and second ends, said segments being mutually unconnected and disposed in radially spaced relationship with each other.

2. The static material-mixing apparatus of claim 1 wherein said conduit and said chamber are circular in cross section.

3. The static material-mixing apparatus of claim 1 wherein each of said segments includes a plurality of angularly-related plates interconnected at opposite ends.

4. The static material-mixing apparatus of claim 3 wherein adjacent plates of said respective segments are angularly related in opposite directions.

5. The static material-mixing apparatus of claim 3 wherein said plates define angles of about thirty degrees to about forty-five degrees with respect to said axis.

6. The static material-mixing apparatus of claim 1 wherein said spaced relationship provides a gap between said two segments of approximately five to eighty percent of the diameter of said chamber.

7. The static material-mixing apparatus of claim 1 wherein said segments are axially staggered.

8. A mixing apparatus comprising a conduit defining a circular chamber open at opposite ends and having center axis, a mixing element in said chamber between opposite ends, said mixing element comprising first and second mixing segments in spaced and mutually unconnected relationship along said axis, each mixing segment comprising a plurality of angularly-related plates joined to each other at opposite ends, each plate having a planar inner edge and an outer edge conforming generally to an inner surface of said conduit, each of said plates occupying less than one-half of said chamber when viewed axially thereof, adjacent plates of said first and second segments being angularly oriented in opposite directions from said axis.

9. The mixing apparatus of claim 8, in which each of said plates is flat and defines an angle of about 35° to about 45° with said axis.

10. The static material-mixing apparatus of claim 8 wherein said spaced relationship provides a gap between said two segments of approximately five to eighty percent of the diameter of said chamber.

* * * * *